United States Patent [19]

Dixon

[11] Patent Number: 4,664,556

[45] Date of Patent: May 12, 1987

[54] METHOD FOR BUILDING STRUCTURES IN WATER

[76] Inventor: Richard K. Dixon, 76 Burges Road, Thorpe Bay, Essex, England, SS1 3HU

[21] Appl. No.: 663,317

[22] Filed: Oct. 22, 1984

[30] Foreign Application Priority Data

Oct. 24, 1983 [GB] United Kingdom ..... 8328404

[51] Int. Cl.[4] ..... E02D 27/22; E02D 29/06

[52] U.S. Cl. ..... 405/223; 405/195; 405/222

[58] Field of Search ..... 405/203–209, 405/195, 267

[56] References Cited

U.S. PATENT DOCUMENTS

| | | | |
|---|---|---|---|
| 559,116 | 4/1896 | Baldwin | 405/204 X |
| 1,758,606 | 5/1930 | Jacobs | 405/204 X |
| 2,972,234 | 2/1961 | Suderow | 405/196 |
| 3,609,978 | 10/1971 | Michie et al. | 52/169.6 X |
| 3,704,595 | 12/1972 | Launay | 405/205 X |
| 3,740,956 | 6/1973 | Guy et al. | 405/205 |
| 4,009,580 | 3/1977 | Dowse | 405/204 |
| 4,103,502 | 8/1978 | Cashman | 405/195 |
| 4,180,350 | 12/1979 | Watts | 405/267 X |
| 4,329,083 | 5/1982 | Parkinson | 405/267 X |

FOREIGN PATENT DOCUMENTS

| | | |
|---|---|---|
| WO80/0708 | 11/1980 | PCT Int'l Appl. . |
| 975975 | 11/1964 | United Kingdom . |
| 1434231 | 5/1976 | United Kingdom . |
| 1460529 | 1/1977 | United Kingdom . |

*Primary Examiner*—Dennis L. Taylor

*Attorney, Agent, or Firm*—McAulay, Fields, Fisher, Goldstein & Nissen

[57] ABSTRACT

A method of construction is provided in which a casing or assemblage of casings which can be handled as a unit is partly immersed in water to a controlled variable depth and used to mould a self-hardenable material such as freshly mixed concrete to form a required shape while isolating it from the surrounding water. Throughout ths stage of construction hydrostatic pressure exerted by the water on the casing or casing assemblage acts in opposition to pressure exerted by the self-hardenable material or by a temporary substitute therefor, (e.g. a bontonite slurry) together with any other forces or pressures that may act. This enables casings to be used which otherwise and for construction in a dry environment would require substantial or extensive support from falsework in order to prevent fracture or undesirable deformation thereof.

11 Claims, 30 Drawing Figures

METHOD FOR BUILDING STRUCTURES IN WATER

Figure 1A:
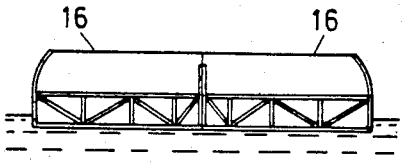

The invention relates to a method of construction for moulding a self-hardenable material, such as concrete, for the purpose of building structures that are located or used in the sea or other body of water. In one aspect of the invention a method is provided by which such a structure can be founded on a hard uneven underwater surface. For convenience concrete is referred to specifically below, but it must be understood that other self-hardenable materials might be used.

Some kinds of marine structure made with concrete require a dry dock, casting basin, or a slipway for their construction so that the concrete can be cast in a dry environment. The structure must then be left to harden sufficiently before launching so that it does not suffer damage. Thus long occupation of the dry construction facility may be necessary which can incur high cost. In a remote and undeveloped location the cost of providing and maintaining a sufficiently large workforce with the necessary range of craft skills to build a dry-construction facility and then the structure will usually be unacceptable. And if a floating dry dock cannot be brought in or is unsuitable for the particular kind of construction, the alternative of towing a completed structure from the nearest developed construction site may be costly and hazardous.

If a pre-cast concrete structure is to be sunk onto a hard irregular underwater surface, preparation of the surface to provide a flat level foundation may be difficult, time-consuming, and costly (see Section 6.6.1 and Section 10.8.2 in "Foundation Design and Construction" by M. J. Tomlinson, published by Pitman, 4th Edition 1980, hereinafter referred to as Tomlinson). In-situ methods of construction may also require much underwater work with similar disadvantages or they may be limited to shallow water (see Tomlinson, Section 10.8.3 and also U.K. Pat. Nos. 1,424,111 and 1,424,112). And if a cofferdam is to be constructed on such a surface, it may be difficult to restrict the seepage of water under the cofferdam and to avoid the risk of collapse (See Tomlinson, Sections 10.4.2 and 10.5). A method of construction in common use in the civil engineering industry, seemingly unrelated to the foregoing problems yet of importance in an aspect of the invention, is that involving the use of bentonite slurry to construct diaphragm walls in foundation on dry land. In the course of the construction, a reinforcing cage is contained in a trench filled with the slurry, a tremie pipe is used to feed concrete into the bottom of the trench, and the tremie pipe is gradually withdrawn as the level of the concrete rises until the whole of the bentonite slurry has been displaced by the concrete (see Tomlinson, Section 5.4.4). It is common practice for slurries to be used in which the concentration of the bentonite in fresh water is 5% to 6% by weight of the slurry (see "Stability of trenches filled with Fluids" by J. K. T. L. Nash, published by the American Society of Civil Engineers, Journal of the Construction Division, No. 11006 December 1974 page 534). Such a slurry has a density that is approximately 1.03 times that of fresh water, which is approximately equal to the density of sea water.

It is an object of the invention here presented, to provide a method for constructing concrete structures used or located in the sea or other body of water that reduces or eliminates the requirement for a dry-construction facility, that requires less skilled manpower at the construction site than is necessary for current methods, and that reduces construction time on site. It is a further object of an aspect of the invention to provide a method by which such a structure can be founded on hard irregular underwater surface with less underwater work and which provides a better seal between the structure and the underwater surface when seepage of water at this interface has to be restricted.

According to the invention there is provided a method of construction in which a casing or an assemblage of casing units at least some of which are prefabricated is partly immersed in water to a controlled variable depth and used to mould a self-hardenable material to form a required shape while isolating it from the surrounding water, wherein throughout this stage of construction hydrostatic pressure exerted by the water on the casing or casing assemblage acting in opposition to pressure exerted by the self-hardenable material or by a temporary substitute therefor, together with any other forces or pressures that may act, whereby casings can be used which otherwise and for construction in a dry environment would require substantial or extensive support from falsework in order to prevent fracture or undesirable deformation thereof.

Also according to the invention if the structure is to be founded on a hard irregular underwater surface, at least that part of the casing or casing assemblage that separates the self-hardenable material from the underwater surface is made of a material that is flexible pliable, or stretchable and wherein a substance that is of a liquid or thixotropic nature is substituted for the self-hardenable material to exert pressure on the casing or casing unit assemblage until it comes into contact with the said underwater surface whereupon the said substitute substance is replaced by the self-hardenable material.

In this specification, a casing is any shell-like form of an impermeable material or composite of materials of which the whole or a substantial part is predominantly rigid or stiff, and which may if required incorporate parts that are flexible, pliable, or stretchable. Preferably the casings are made of a light-weight non-corrodible material such as fibre-reinforced plastic (known as "FRP")of which various kinds may be suitable. Flanges, ribs, or other means for stiffening or reinforcing the casing or making connections, may form an integral part of the casing. Either the inside surface or the outside surface of the casing may be used for moulding the self-hardenable material. The casings will normally remain permanently in position but if required suitable provision may be made to remove the whole or a part of a casing after the self-hardenable material has gained sufficient strength.

Preferably a plurality of structural members in the form of struts, ties, or diaphragms are connected to the casing or casings and are located in the general space to be occupied by the self-hardenable material. These structural members may or may not be connected one with another and they are referred to collectively as the internal framework. The purpose of the internal framework is to provide support to the casing or casings, to provide a means by which a plurality of casings may be located and held in their correct positions one with another, and to facilitate the fixing of any reinforcement that is to be embedded in the self-hardenable material. The casing or assemblage of casings, together with such internal framework as may be required is referred to as the "casing structure"; prefabricated parts of the casing structure are referred to as "casing units".

The casing structure may be constructed either before or in conjunction with the admission of the self-hardenable material or temporary substitute substance. Preferably at least a substantial proportion of the self-hardenable material or temporary substitute substance is admitted when the casing structure or partly completed casing structure is either afloat or suspended in the water, the depth of immersion being varied by controlling the buoyancy and the force in any suspension cables when these are attached. However, for some kinds of structure and if required, the casing structure may be assembled in a dry dock and the depth of immersion varied by controlling the amount of water admitted to the dry dock. Care must be taken both in the design of the complete structure and in the way it is constructed to ensure that buoyancy forces and dead weight forces are sufficiently well balanced against each other, and that forces from any suspension cables or means of support in a dry dock are transmitted and distributed to the casing structure in a suitable manner so that self-hardenable material not long set and with little developed strength is not subjected to stresses that can cause permanent damage to it. This is especially important if the structure is elongate with the long axis horizontal; a length of submerged tunnel provides an example of this kind of structure.

If required, provision may be made for controlling the temperature and humidity of the space within the casing structure to provide more suitable conditions in which the self-hardenable material can set and gain strength. Because this space is mostly surrounded by water that will have a more moderate and smaller range of temperature than that of the air at any location, temperature control is facilitated.

An advantage offered by the method of the invention is that in addition to satisfying the objects stated hereinbefore, the invention may enable concrete marine structures to be built in some intemperate locations where otherwise this would be impossible or where construction would be accompanied by long delays waiting for favourable weather conditions. Also the casings when left permanently in place, will protect the concrete from possible deterioration, thereby reducing the incidence of difficult or costly repair work and extending the life of the structure in some instances.

Figure 2A:
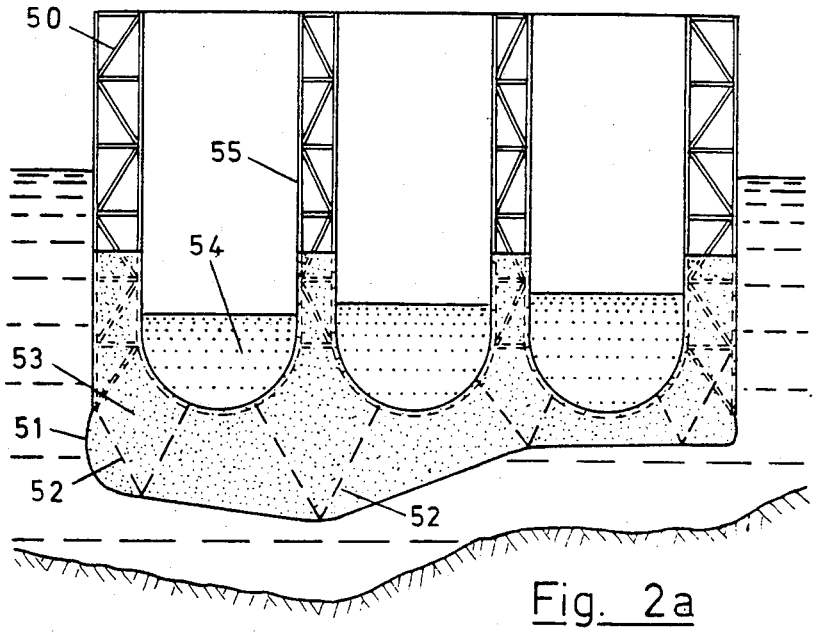
Figure 2B:
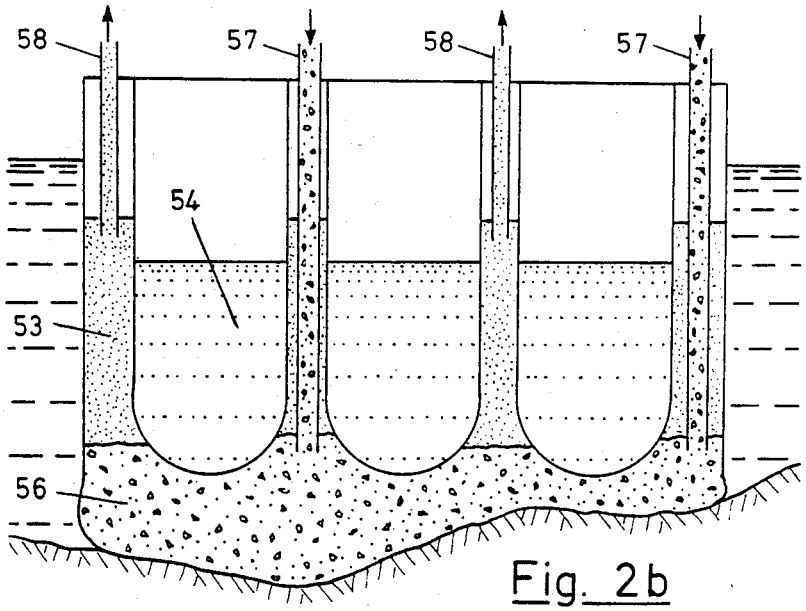
Figure 3A:
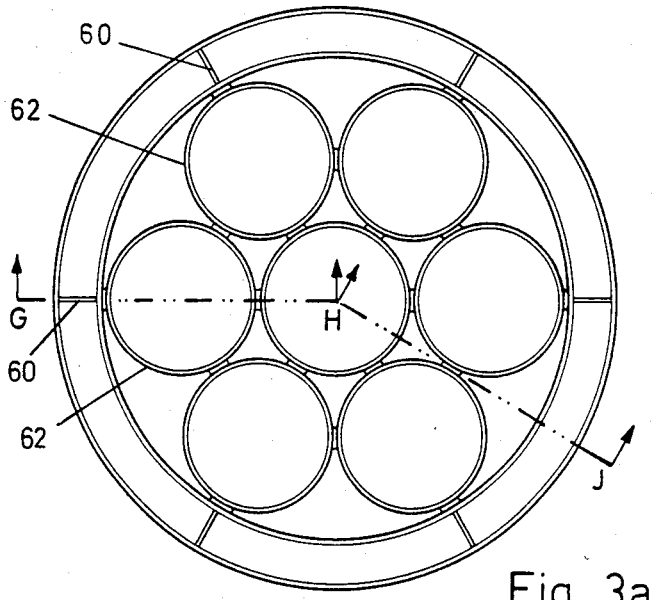
Figure 3B:
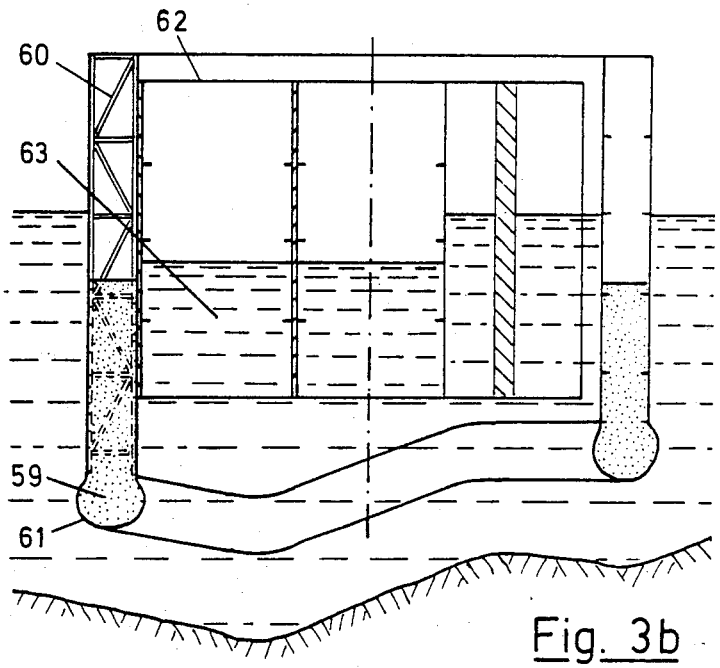
Figure 4A:
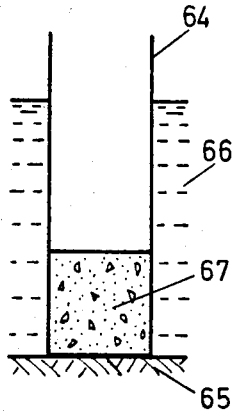
Figure 4B:
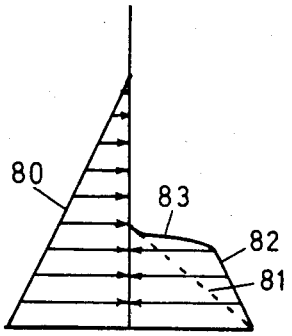
Figure 4C:
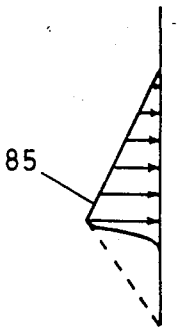

Some embodiments of the invention will now be described by way of example with reference to the following drawings in which;

FIGS. 1*a* to 1*e* are sectional elevations through a fixed platform at successive stages of construction respectively;

FIGS. 2*a* and 2*b* are cross-sections through a box caisson at successive stages of construction respectively;

FIGS. 3*a* and 3*b* both relate to an open caisson in the course of construction and installation; FIG. 3*a* is a plan view, and FIG. 3*b* is a sectional elevation on GHJ of FIG. 3*a*.

Figure 8A:
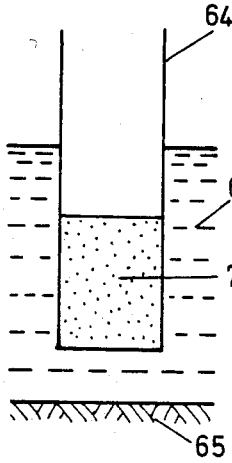
Figure 9A:
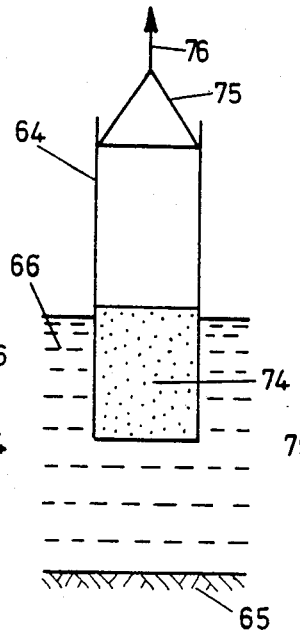
Figure 10A:
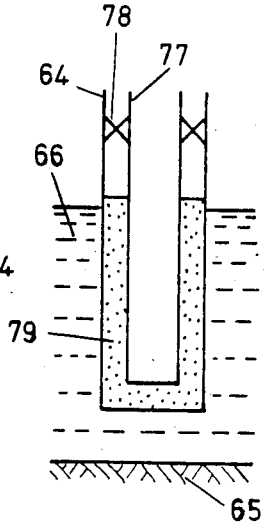
Figure 8B:
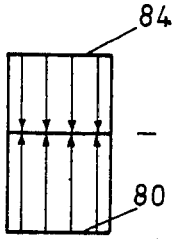
Figure 9B:
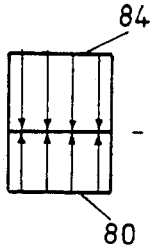
Figure 10B:
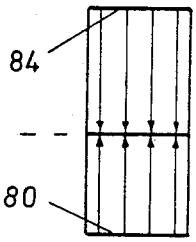
Figure 8C:
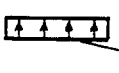
Figure 9C:
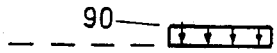
Figure 10C:
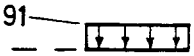

FIGS. 4*a* to 10*c* inclusive are diagrammatic representations which relate to a casing in the form of a large rigid hollow cylinder with one closed rigid end which is partly immersed in water. Each of these figures is presented in three corresponding parts: part "a" is a vertical section on a diametral plane of the cylinder; part "b" is a pressure diagram representing the opposing pressures acting on a portion of the cylinder; part "c" is a pressure diagram corresponding to part "b" and representing the net pressure acting on the same portion of the cylinder. In FIGS. 4 to 10 inclusive, one scale is used throughout to represent linear dimensions, and one scale is used throughout to represent pressure. FIGS. 4, 5, 6 and 7 illustrate the distribution of pressure on the sides of the casing; FIGS. 8, 9 and 10 illustrate the distribution of pressure on the bottom of the casing.

The scale of all of the drawings does not enable the casings to be shown as entities with cross-sectional thickness.

Figure 1B:
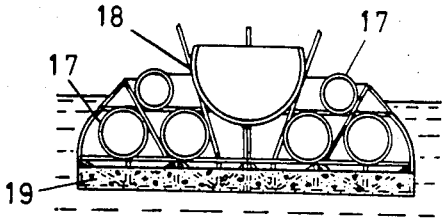
Figure 1C:
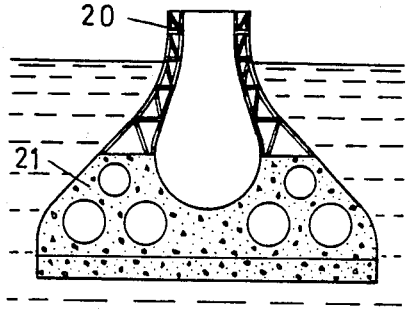
Figure 1E:
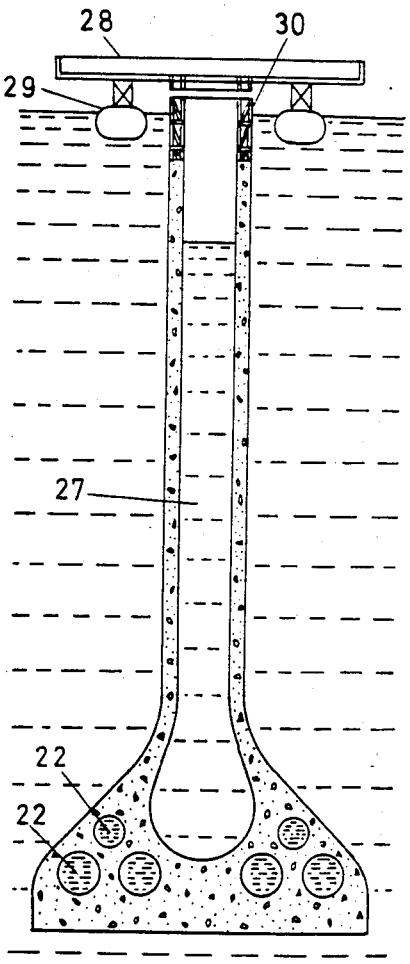
Figure 1D:
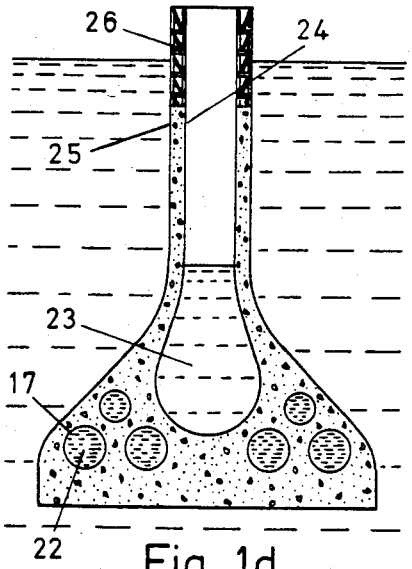

In FIG. 1*a*, casing units 16 that are sectors of a circle in plan and that float in water are connected together by suitable means such as bolts, welds or tensioned cables. In FIG. 1*b*, annular water-ballast tanks 17 are installed; these are filled with air under pressure to strengthen this part of the casing structure, and more casing units 18 added. If necessary, a bed of reinforced concrete 19 is laid in the bottom of the casing structure and allowed to mature to give additional strength before proceeding with the construction. In FIG. 1*c*, more casing units 20 and concrete 21 have been added. The casing units 20 define an internal casing 24 and an external casing 25. The construction continues in this manner as in FIG. 1*d*, and, if required for the purpose of adjusting the depth at which the partly completed structure floats, the air pressure in the annular water-ballast tanks may now be released and ballast water 22 introduced. More ballast water 23 may be introduced into the internal casing 24 which also serves the purpose of supporting the casing. Alternatively or additionally, temporary stops may be incorporated in the internal casing 24 so that the contained fluid or fluids may be pressurized in order to give additional support to this casing, and indirectly to the external casing 25 through strengthening the internal framework 26. When the construction has reached the required height as in FIG. 1*e*, and after adding more ballast water 27 as necessary, a platform 28 supported by pontoons 29 is floated into position and secured to the leg 30. After completing the concrete construction, the ballast water 22, 27 is pumped out to elevate the platform in the water, and then it can be towed elsewhere for use.

FIGS. 2*a* and 2*b* illustrate a method for founding a box caisson on a rocky uneven sea or river bed in a moderate depth of water. The casing structure incorporates a flexible bag 51, pre-formed to the approximate shape of the sea bed where it is to be located. The bag 51 is preferably supported by flexible ties or struts 52 or other means in order to prevent substantial and uncontrollable distortion of the bag due to the differing distributions of pressure inside and outside the bag. Bentonite slurry 53 is pumped into a casing structure 50, and any suitable fluid 54 pumped into the casing 55. By suitable control of the rate at which the bentonite 53 and the fluid 54 are pumped into position, the casing structure is sunk to the sea bed in an upright position with the flexible bag 51 remaining in a fully extended position. Concrete 56 is then substituted for the bentonite 53, the concrete being pumped into position through a tremie pipe 57 which is gradually withdrawn as the concrete level rises, and the displaced bentonite removed through a pipe 58.

Similar principles are applied to sink an open caisson to a rocky uneven sea bed as in FIG. 3*a* and 3*b*. Bentonite 59 is pumped into a casing structure 60 which incorporates a flexible bag 61, but in this example, removable water-ballast tanks 62 for receiving water ballast 63 are incorporated inside the caisson. As before, the rate at which the bentonite 59 is pumped into place, and the rate at which water-ballast 63 is admitted to the tanks are both controlled so that the flexible bag 61 remains fully extended while the casing structure is sunk to the sea bed. Concrete is substituted for the bentonite as before, and the water-ballast tanks removed. Alternatively the water ballast tanks 63 could be replaced with other forms of tank secured to the outside of the casing structure 60. Or the water ballast tanks may be dispensed with altogether and the casing structure suspended from a derrick mounted on a fixed or floating platform.

Figure 5A:
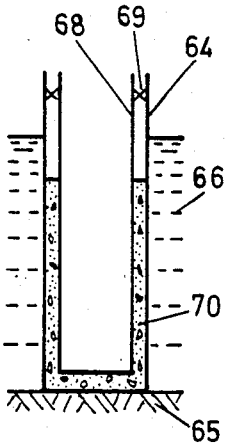
Figure 5B:
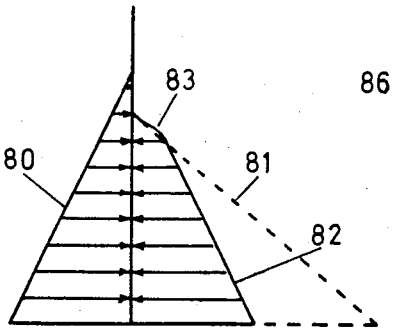
Figure 5C:
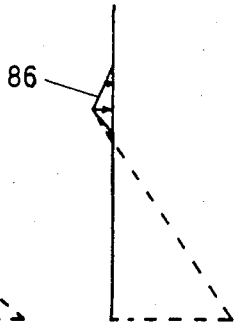
Figure 6A:
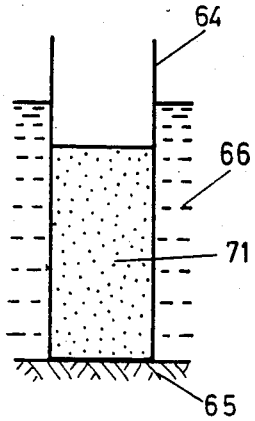
Figure 6B:
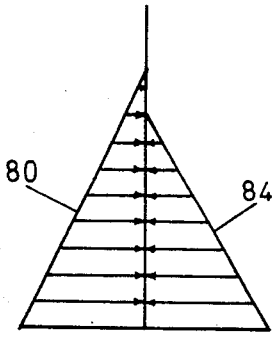
Figure 6C:
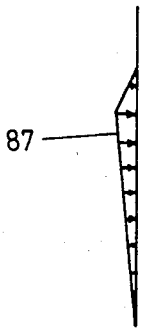
Figure 7A:
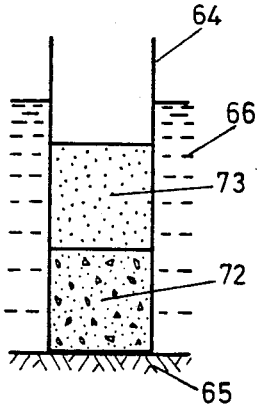
Figure 7B:
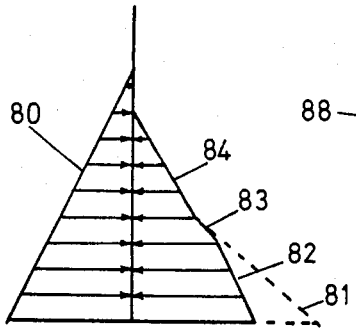
Figure 7C:
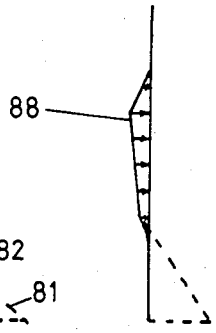

Referring to FIGS. 4*a*, 5*a*, 6*a*, 7*a*, 8*a*, 9*a* and 10*a*, a casing 64 is partly immersed in water 66 overlying a flat horizontal bottom 65. The casing contains either concrete 67, 70 or a bentonite slurry 71, 74, 79 or a combination of concrete 72 and bentonite slurry 73. The volume of concrete 67, 70 and 72 are equal to one another and of the same weight as the bentonite slurry 71. In FIG. 5*a* a second rigid casing 68 is attached by rigid connections 69 (shown only in part) to casing 64 so that the concrete 70 occupies a greater height within casing 64. Likewise, in FIG. 10*a* a second rigid casing 77 is connected to casing 64 by rigid connections 78 which causes the bentonite slurry 79 to occupy a greater height within casing 64. In FIGS. 4*a*, 5*a*, 6*a* and 7*a* the casing 64 rests on the bottom 65; in FIGS. 8*a* and 10*a* the casing 64 floats freely; in FIG. 9*a* the casing 64 is raised above the free-floating position by means of an upward force 76 applied through a lifting bracket 75.

Referring to FIGS. 4*b*, 5*b*, 6*b*, 7*b*, 8*b*, 9*b* and 10*b*, 80 represents the hydrostatic pressure acting on the outside of the casing 64, 81 represents the pressure exerted by fluid concrete, 82 represents the reactive pressure exerted by hardened concrete, 83 represents the pressure exerted by concrete in a semi-fluid state and in the early stages of strength development, and 84 represents the hydrostatic pressure exerted by a bentonite slurry. The arrows contained within these envelopes indicate the direction in which the pressures act. The shape and extent of envelope 83 is dependent on a number of variables and is symbolic only. Otherwise, the envelopes have been obtained by assuming that the density of concrete is 2.4 times the density of water, and that the density of the bentonite slurry is 1.2 times the density of water. This slurry density is higher than that normally used in order to give greater clarity to the diagram which are meant to illustrate principles. Furthermore, it will be seen that the greatest benefit from using the bentonite is derived when the slurry density is close to that of the surrounding water, so that by assuming a higher density for the pressure diagrams the advantage appears to be less than would occur in practice. For FIGS. 4*b*, 5*b* and 6*b*, the dead weight of the casing 64, or assemblage of casings 64, 68 and 69, is assumed to equal the reactive force on the bottom 65. For a casing of practicable weight this reaction is likely to be small compared with the other forces, and in these circumstances the pressure diagrams of FIGS. 4*b*, 5*b* and 6*b* will be similar to those for a casing floating freely, and give a qualitative illustration of the way in which the pressure will develop as the casing 64 is sunk to the bottom by placing material within it.

Referring to FIGS. 4*c*, 5*c*, 6*c*, 7*c*, 8*c*, 9*c* and 10*c*, the net pressures derived from the corresponding one of FIGS. 4*b*, 5*b*, 6*b*, 7*b*, 8*b*, 9*b*, and 10*b* are given by envelopes 85 to 91 inclusive. Comparison of envelopes 85 and 86 shows how the introduction of a buoyancy tank within the concrete mass reduces the net pressure on the casing during construction. Comparison of envelopes 85, 87, and 88 shows how the use of bentonite slurry in the construction process reduces the net pressure acting on the casing. Consequently the use of either of these methods alone or their combined use enables lighter and less rigid casings to be used than would otherwise be possible, having regard to the nature of envelope 83 in FIG. 4*b* at which point flexure of the casing 64 may cause permanent damage to concrete that is setting and starting to harden. Comparison of envelopes 89, 90 and 91 shows how the pressure on the bottom of the casing 64 may be controlled. Additionally if water or other ballast is introduced into casing 77 in FIG. 10*a*, envelope 84 in FIG. 10*b* would remain unchanged while envelope 80 in the same figure would increase in magnitude, with the result that envelope 91 in FIG. 10*c* would be reduced in magnitude, or reduced to zero, or reversed in direction depending on the amount of ballast introduced. Thus if the rigid bottom of the casing 64 is replaced by a pliable membrane, simultaneous control of the amount of bentonite slurry 79 and ballast introduced into casing 77 will provide a means whereby the pressures acting on the membrane can be closely controlled as the casing assemblage is sunk to the bottom and when on the bottom.

I claim:

1. A method of building structures in water, comprising the steps of:

(a) introducing into the water a substantially rigid casing or assemblage of casing units, at least some of which are prefabricated, the casing or the said assemblage provided for molding a self-hardenable material to a desired shape while isolating it from the surrounding water;

(b) introducing self-hardenable material, or a temporary substitute therefor, into the casing or the said assemblage;

(c) while the self-hardenable material or said substitute is being introduced, controlling the buoyancy of the casing or of the said assemblage and thereby the depth to which the casing or the said assemblage is immersed in the water, so that the hydrostatic pressure exerted by the water on the casing or the said assemablage is opposed by the pressure exerted by the self-hardenable material or said substitute;

(d) lowering the casing or said assemblage onto an underwater surface; and (e) where a substitute was introduced instead of the self-hardenable material, gradually replacing said substitute with self-hardenable material.

2. A method according to claim 1, wherein the casing or said assemblage comprises an internal and an external casing, the internal casing forming a buoyancy tank into which liquid can be introduced.

3. A method according to claim 1, wherein the casing or said assemblage is supported by a suspension cable as well as by its buoyancy.

4. A method according to claim 1, wherein the casing or said assemblage remain as a permanent part of the finished structure.

5. A method according to claim 1, wherein in order to allow the self-hardenable material to conform to the shape of an irregular underwater surface, at least that part of the casing or said assemblage that separates the self-hardenable material from the underwater surface is made of a material that is flexible, pliable, or stretchable and wherein a substance that is of a liquid or thixotropic nature is substituted for the self-hardenable material to exert pressure on the casing or casing unit assemblage until it comes into contact with the said underwater surface whereupon the said substitute substance is replaced by the self-hardenable material.

6. A method according to claim 5, wherein said substitute substance is replaced by the self-hardenable material using a method of displacement progressing upwards from the bottom.

7. A method according to claim 5, wherein said substance is a slurry of bentonite in water.

8. A method according to claim 1, wherein the assemblage of casing units is used, and wherein a plurality of substages is involved in each of which at least one additional casing unit is added and further self-hardenable material or temporary substitute material is added.

9. A method according to claim 8, comprising the steps of forming an initial bed of self-hardenable material in one of the casing units and allowing said material to harden before proceeding with the construction.

10. A method according to claim 1, wherein a pressurized enclosure is defined within a self-hardenable material to strengthen the casing or casing unit assemblage.

11. A method according to claim 1, wherein the self-hardenable material is concrete.

* * * * *